US006758717B1

(12) United States Patent
Park et al.

(10) Patent No.: US 6,758,717 B1
(45) Date of Patent: Jul. 6, 2004

(54) DOLL HAVING CHANGEABLE EYES AND REMOVABLE ALTERNATIVE FACE

(75) Inventors: Cassidy Park, Pve, CA (US); Tina Yang, Placentia, CA (US); Elaine Marans, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/611,381

(22) Filed: Jun. 30, 2003

(51) Int. Cl.[7] ..... A63H 3/36

(52) U.S. Cl. ..... 446/391; 446/321; 446/337; 446/339; 446/343

(58) Field of Search ..... 446/337, 338, 446/339, 340, 341, 343, 321, 391

(56) References Cited

U.S. PATENT DOCUMENTS

| | | | | | |
|---|---|---|---|---|---|
| 1,496,406 | A | * | 6/1924 | Bertsch | 446/341 |
| 1,821,243 | A | * | 9/1931 | Springer | 446/341 |
| 2,208,219 | A | * | 7/1940 | Maibaum | 446/301 |
| 2,475,508 | A | * | 7/1949 | Mandell | 446/342 |
| 2,669,802 | A | * | 2/1954 | Olivier | 446/321 |
| 2,670,568 | A | * | 3/1954 | Walss | 446/303 |
| 2,938,302 | A | * | 5/1960 | Walss | 446/341 |
| 2,954,639 | A | * | 10/1960 | Walss | 446/338 |
| 4,246,723 | A | * | 1/1981 | Winters | 446/345 |
| 5,676,584 | A | * | 10/1997 | Perryman | 446/321 |
| 5,971,763 | A | * | 10/1999 | Yau | 434/100 |
| 6,558,221 | B1 | * | 5/2003 | Yang | 446/100 |

FOREIGN PATENT DOCUMENTS

| | | | | |
|---|---|---|---|---|
| JP | 04180791 | A | * 6/1992 | A63H/3/40 |

* cited by examiner

*Primary Examiner*—Derris H. Banks
*Assistant Examiner*—Ali Abdelwahed
(74) *Attorney, Agent, or Firm*—Roy A. Ekstrand

(57) ABSTRACT

A doll head defines a pair of eye apertures and a pair of outwardly extending ears. A mask also having eye apertures and ear portions is removably attached to the doll head to overlie the facial portions thereof. The mask includes a snap fit attachment which engages the ear portions of the doll head. The apertures of the mask generally align with the eye apertures of the doll head when the mask is attached. An eye change mechanism supportive within the doll head provides alternative eye images viewed through the respective eye apertures of the head and mask.

4 Claims, 2 Drawing Sheets

DOLL HAVING CHANGEABLE EYES AND REMOVABLE ALTERNATIVE FACE

FIELD OF THE INVENTION

This invention relates generally to dolls and other toy figures and particularly to apparatus for providing alternative facial expressions and in particular, eye features.

BACKGROUND OF THE INVENTION

Perhaps one of the oldest if not the oldest types of toys known in the art is found in toys generally described as dolls or toy figures often referred to collectively as dolls. From earliest recorded times, history has shown that children in virtually all cultures and geographic locations have at some point utilized some type of figure fashioned generally to resemble a human or animal. Dolls have varied from early simple often-crude fabrications to modern high technology multi-function dolls capable of providing a very life-like activity. Not surprisingly, the long term and continuous popularity of dolls has prompted practitioners in the art to develop a virtually endless variety of dolls. Thus, dolls have been provided which replicate virtually any activity indulged in by humans or human infants, For example, dolls have been provided which included mechanical apparatus enabling the doll to walk, crawl, talk or otherwise move. Still other dolls have been directed to lifestyle functions and have been provided with apparatus enabling the doll to indulge in activities such as crying, go potty, drinking and eating. Still other dolls have been provided which include apparatus directed toward altering or enabling features related to facial expression or appearance. One facial feature, which has often received substantial attention from practitioner in the toy arts, has been directed toward providing various types of eye features in dolls. As a result, a great number of dolls have been provided which enjoy the common feature of having changeable or interchangeable eyes and eye expression. For example, U.S. Pat. No. 1,821,243 issued to Springer sets forth a FACIAL CHANGE DEVICE FOR DOLLS having a substantially hollow doll head which defines mouth and eye apertures. Within the doll head cavity, apparatus is provided for supporting a plurality of mouth images in alignment with the mouth aperture and a plurality of eye images in alignment with the eye apertures. A ratchet mechanism is operative to change the mouth and eye images appearing through the apertures in response to position or attitude of the doll.

U.S. Pat. No. 2,475,508 issued to Mandell sets forth a DOLLS HEAD having a hollow head defining a pair of eye apertures. A pair of generally spherical elements are rotatably supported in alignment with the eye apertures. A movement mechanism supported within the doll head is operative in response to a pendulum weight to bring different eye images defined on the spherical elements into alignment with the eye apertures and thereby produce changing eye images or expression.

U.S. Pat. No. 2,670,568 issued to Walss sets forth EYE MOVEMENT FOR DOLLS AND THE LIKE having a hollow doll head defining eye apertures therein. A pair of spherical elements are rotatably supported within the doll head and define a plurality of eye images which are selectively aligned with the apertures to change expression of the dolls eyes.

U.S. Pat. Nos. 2,954,639 and 2,938,302 both issued to Walss set forth a doll structure having a pair of rotatable eye image baring elements within the doll head. The doll further includes a displaceable portion within the doll torso, which is coupled to an operative mechanism for moving the eye image elements.

U.S. Pat. No. 4,246,723 issued to Winters sets forth COLOR CHANGEABLE EYES DEVICE FOR MANIKIN HEADS having a pair of eye apertures behind which a corresponding pair of spherical elements each supporting a plurality of eye images is supported within the doll or manikin head. The support apparatus for the eye image elements is coupled to a plurality of gears terminating in a larger diameter gear having a portion extending outwardly through a slot formed in the back of the doll or manikin's head. The exposed portion of the large diameter gear provides a thumb wheel for changing the eye images aligned with the eye apertures.

U.S. Pat. Nos. 1,496,406; 2,208,219 and 2,669,802 set forth additional apparatus similar to the above-described prior art devices directed toward changing the dolls eyes viewed through apertures in the dolls head.

The foregoing described prior art devices are merely illustrative of a great number of doll structures which have been provided and which have been directed toward obtaining changeable facial features and changeable eyes in dolls or manikins. Despite the substantial number of doll structures provided, there remains nonetheless a continuing need in the art for evermore improved, interesting and amusing dolls and toy figures.

SUMMARY OF THE INVENTION

Accordingly, it is a general object of the present invention to provide an improved doll. It is a more particular object of the present invention to provide an improved doll having changeable eyes and alternative facial appearance. It is a still more particular object of the present invention to provide an improved doll in which the feature of changeable eyes and alternative facial appearance are provided in a cooperating manner to produce a substantial improvement in doll amusement value.

In accordance with the present invention there is provided a doll head comprising: a head housing defining an interior cavity, a pair of doll eye apertures and a pair of ear portions; an eye change mechanism supported within the interior cavity having a plurality of eye images and means for aligning a selected pair of the doll eye images with the eye apertures; and a facial mask having a facial portion, a pair of ear elements and a pair of mask eye apertures, the facial mask being removably securable to the doll head by engagement of the ear elements with the ear portions such that the mask eye apertures generally align with the doll eye apertures.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
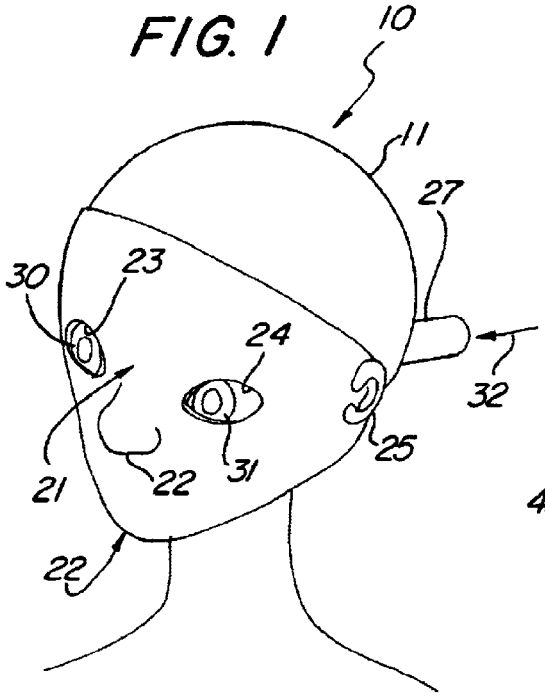
FIG. 1 sets forth a perspective view of a doll head constructed in accordance with the present invention having the removable facial mask attached.

FIG. 1 sets forth a perspective view of a doll head constructed in accordance with the present invention and generally referenced by numeral 10. Doll head 10 includes a head housing 11 supporting a rearwardly extending pushrod 27. By means set forth below in greater detail, doll head 10 further supports a pair of eye images 30 and 31. In further accordance with the present invention, doll head 10 includes a removable facial mask 20 having a facial portion 21 conforming generally to housing 11 and defining a pair of eye apertures 23 and 24. By means also set forth below in greater detail, eye images 30 and 31 are exposed through apertures 23 and 24 of facial mask 20. Facial mask 20 is configured to generally correspond to a face and frontal head portion of a doll. Accordingly, mask 20 further defines a number of features such as nose 22 and a pair of ears 25 and 26 (ear 26 seen in FIG. 2).

In the preferred fabrication of the present invention, mask 20 is formed of substantially resilient material such as molded plastic or the like and is secured to head housing 11 in a snap-fit attachment at ears 25 and 26 in the manner set forth below in FIG. 2. Suffice it to note here that mask 20 assembled to head housing 11 provides an alternative face having a predetermined appearance and facial expression which overlies the underlying face and features of housing 11 (seen in FIG. 3). Notwithstanding the overlie cover of facial mask 20, apertures 23 and 24 maintain the visibility of eye images 30 and 31 when the mask is assembled to head housing 11.

In accordance with the present invention and by means described below in greater detail, doll head 10 may be utilized having mask 20 overlying head housing 11 to achieve a particular facial appearance or alternatively provided with a different facial appearance such as that shown in FIG. 3 by removing facial mask 20. In both instances by means also set forth below in greater detail, the manipulation of pushrod 27 inwardly in the direction indicated by arrow 32 in both instances of mask 20 being attached or removed facilitates the change of eye images 30 and 31 to a different set of eye images. In this manner, the appearance of doll head 10 is able to be substantially change both as to general appearance and expression as desired. It will be apparent to those skilled in the art that in the preferred fabrication of doll head 10 a quantity of simulated hair (not shown) is rooted to doll head 10 in accordance with conventional fabrication techniques.

Figure 2:
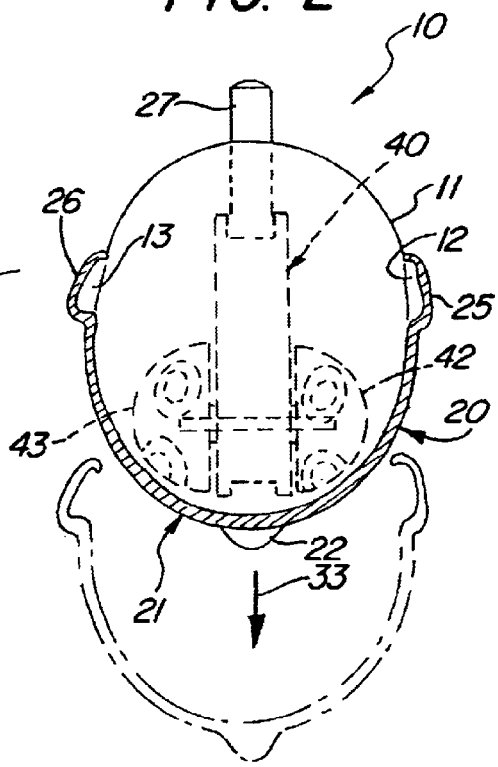
FIG. 2 sets forth a top section view of the doll head of FIG. 1 showing the removable mask separated and drawn in phantom line depiction.

FIG. 2 sets forth a top view of doll head 10 showing facial mask 20 in section view. In FIG. 2, facial mask 20 is also shown in phantom line depiction having been removed from head housing 11 of doll head 10.

More specifically, doll head 10 includes a head housing 11 supporting a pair of outwardly extending ears 12 and 13. Within doll head housing 11, by means described below in greater detail, an eye change mechanism generally referenced by numeral 40 is supported. While the structure of mechanism 40 is described below in greater detail, suffice it to note here that mechanism 40 supports a pair of hemispherical elements 42 and 43 within the interior of housing 11 which are manipulated by the press and release of pushrod 27. As described above, facial mask is formed of a resilient material and is snap fitted to the facial portion of head housing 11 to overlie the facial features thereof (seen in FIG. 3). Of importance to note in FIG. 2, is the configuration of ear portions 25 and 26 of mask 20 to cooperate with ears 12 and 13 of head housing 11 to secure mask 20 against the facial portion of head housing 11. Nose 22 of mask 20 is located to generally overlie the nose portion of head housing 11 (nose 15 seen in FIG. 3).

In accordance with an important aspect of the present invention, facial mask 20 is removable from or securable to head housing 11 in a simple snap-fit attachment. This is illustrated in FIG. 2 as mask 20 is shown in solid line representation secured to head housing 11 in a snap-fit attachment and also shown in phantom line depiction having been removed from head housing 11. Simply stated, mask 20 is removed by pulling it forwardly from head housing 11 in the direction indicated by arrow 33. With sufficient force applied to facial mask 20, the resilience of the mask material allows ear portions 25 and 26 to be deflected outwardly and release ears 12 and 13.

Figure 3:
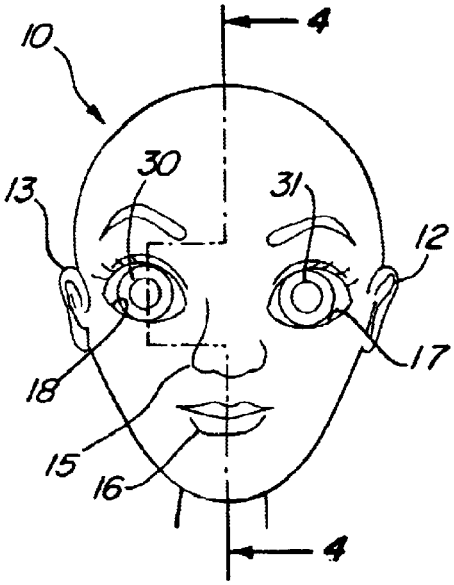
FIG. 3 sets forth a front view of the doll head of FIG. 1 with the mask removed.

FIG. 3 sets forth a front view of doll head 1 having mask 20 removed therefrom. As mentioned above, doll head 10 generally resembles a human doll head and includes a head housing 11 having a number of facial features including a nose 15, a pair of ears 12 and 13 and a mouth 16. In addition, head housing 11 defines a pair of eye apertures 17 and 18. Hemispherical elements 42 and 43 (seen in FIG. 2) support eye images 30 and 31 in alignment with apertures 18 and 17 respectively. As a result, the appearance of doll head 10 includes the exposure of eye images 30 and 31. In accordance with the operation of eye change mechanism 40 (described below), the particular eye images exposed through apertures 17 and 18 may be changed to vary the appearance and facial expression of doll head 10.

Figure 4:
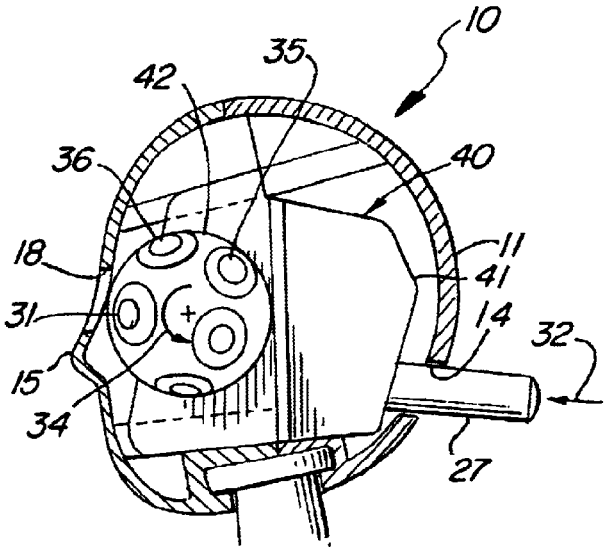
FIG. 4 sets forth a section view of the doll head of FIG. 3 taken along section lines 4—4 therein.

FIG. 4 sets forth a section view of doll head 10 taken along section lines 4—4 in FIG. 3. As described above, doll head 10 includes a head housing 11 having a pair of eye apertures 17 and 18 (aperture 17 seen in FIG. 3). Head housing 11 further defines an aperture 14 through which a pushrod 27 of an eye change mechanism supported within the interior of housing 11 extends. The operation and structure of eye change mechanism 40 is described below in FIGS. 5 and 6 in greater detail. However, suffice it to note here that eye change mechanism 40 includes a housing 41 supported within the interior of head housing 11. Further eye change mechanism 40 includes a pair of hemispherical elements 42 and 43 (element 43 seen in FIG. 2). As is described below in greater detail, hemispherical elements 42 and 43 are rotated incrementally in response to the press and release of pushrod 27 inwardly in the direction indicated by arrow 32. Suffice it to note here that as pushrod 27 is pressed inwardly, in the direction indicated by arrow 32 and released, hemispherical elements 42 and 43 (seen in FIG. 2) are incrementally rotated in the direction indicated by arrow 34.

In further accordance with the present invention, hemispherical elements 42 and 43 define pluralities of eye images. By way of illustration, hemispherical element 42 defines an eye image 31 presently in alignment with eye aperture 18 together with alternative images such as eye images 36 and 35. It will be apparent from examining FIG.

4 and temporary return to FIG. 2, that the alignment of the respective eye images of head housing 11 and mask 20 allow the eye images to be viewed through the respective eye apertures of doll head 10 whether mask 20 is attached or removed.

Figure 6:
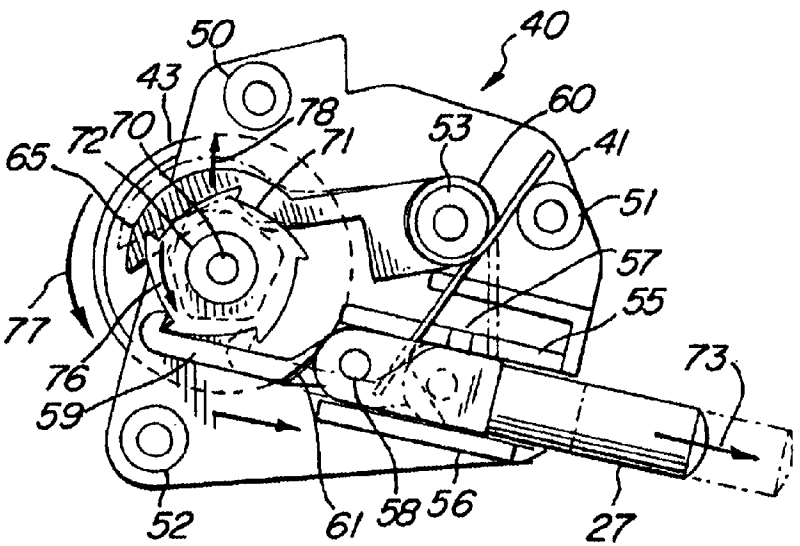
FIG. 6 sets forth the eye changing apparatus of the present invention doll during the initiation of an eye image changing process.
Figure 5:
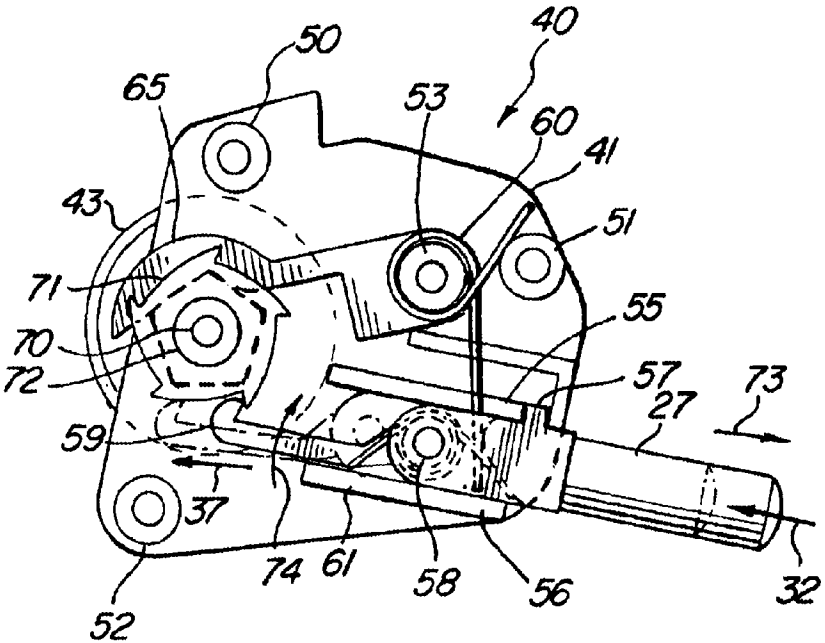
FIG. 5 sets forth a side view of the eye movement mechanism of the present invention doll prior to initiation of an eye image change cycle.

By way of overview, FIGS. 5 and 6 set forth partially sectioned views of the operative mechanism of eye change mechanism 40. FIG. 5 shows eye change mechanism 40 at the initiation of an eye change cycle while FIG. 6 shows eye change mechanism 40 during the change of eye images.

More specifically, eye change mechanism 40 includes a housing 41 having a plurality of support posts 50, 51 and 52 for securing the half portions of housing 41 together to form an integral housing unit. Eye change mechanism 40 further includes a post 53 supporting a spring 60 and a pair of elongated spaced apart guide elements 55 and 56. Guide elements 55 and 56 receive the interior portion of a pushrod 27. Pushrod 27 includes an internal end having a pin 58 supported therein. One end of spring 60 is positioned against post 51 while the remaining end is positioned against an interior portion of pushrod 27. The action of spring 60, which results urges pushrod 27 outwardly to a position, maintained by a stop member 57.

An elongated claw 59 is pivotally secured to the interior end of pushrod 27. Claw 59 is pivotally moveable about the interior end of pushrod 27. A spring 61 is received upon pin 58 and is coupled to pushrod 27 and claw 59. The action of spring 61 provides a spring free, which urges claw 59 inwardly in the direction indicated by arrow 74.

Eye change mechanism 40 further includes a transversely extending shaft 70 supporting a toothed wheel 71. Wheel 71 is joined to a post 72, which extends in each direction from toothed wheel 71 and is secured to hemispherical elements 42 and 43 (element 42 seen in FIG. 2). Thus, the entire structure of post 72, wheel 71 and hemispherical elements 42 and 43 is rotatable upon shaft 70 as a single unit. A detent member 65 is secured to post 53 and engages toothed wheel 71 to provide a detent action to the rotation of toothed wheel 71 and hemispherical elements 42 and 43.

In operation, in the absence of an inward force upon pushrod 27, spring 60 urges pushrod 27 outwardly until stop 57 engages the cooperating element of housing 41. Correspondingly, claw 59 is drawn to the position shown in FIG. 5. Toothed wheel 71 and hemispherical elements 42 and 43 (element 42 seen in FIG. 2) are maintained in the rotational position shown in FIG. 5 by the action of detent 65 upon toothed wheel 71. At this point, a pair of eye images upon elements 42 and 43 are viewable through the respective eye apertures of doll head 10 in the manner seen in FIG. 1.

The change of eye images is initiated by an inward force upon pushrod 27 in the direction indicated by arrow 32. This force must be sufficient to overcome the outward force of spring 60 upon pushrod 27 which otherwise urges it outwardly in the direction indicated by arrow 73. As the inward force in the direction of arrow 32 is increased overcoming the force of spring 60, the combined structure of pushrod 27 and claw 59 is moved inwardly in the direction indicated by arrow 37. During this time, the interior end of claw 59 is able to slide upon the slightly curved surface of toothed wheel 71 and no movement of toothed wheel 71 occurs. The inward stroke continues until the structure of pushrod 27 and claw 59 reaches the position shown in FIG. 6.

As mentioned above, FIG. 6 shows the operation of eye change mechanism 40 as an eye change cycle is commenced. In the position shown in FIG. 6, it will be understood that the above described inward movement of pushrod 27 has been completed allowing claw 59 to grasp the next tooth of toothed wheel 71.

More specifically, eye change mechanism 40 includes a housing 41 having a plurality of support posts 50, 51 and 52 for securing the half portions of housing 41 together to form an integral housing unit. Eye change mechanism 40 further includes a post 53 supporting a spring 60 and a pair of elongated spaced apart guide elements 55 and 56. Guide elements 55 and 56 receive the interior portion of a pushrod 27. Pushrod 27 includes an internal end having a pin 58 supported therein. One end of spring 60 is positioned against post 51 while the remaining end is positioned against an interior portion of pushrod 27. The action of spring 60 which results urges pushrod 27 outwardly to a position maintained by a stop member 57.

An elongated claw 59 is pivotally secured to the interior end of pushrod 27. Claw 59 is pivotally moveable about the interior end of pushrod 27. A spring 61 is received upon pin 58 and is coupled to pushrod 27 and claw 59. The action of spring 61 provides a spring force, which urges claw 59 inwardly in the direction indicated by arrow 74.

Eye change mechanism 40 further includes a transversely extending shaft 70 supporting a toothed wheel 71. Wheel 71 is joined to a post 72, which extends in each direction from toothed wheel 71 and is secured to hemispherical elements 42 and 43 (element 42 seen in FIG. 2). Thus, the entire structure of post 72, wheel 71 and hemispherical elements 42 and 43 is rotatable upon shaft 70 as a single unit. A detent member 65 is secured to post 53 and engages toothed wheel 71 to provide a detent action to the rotation of toothed wheel 71 and hemispherical elements 42 and 43.

In operation, once pushrod 27 has moved claw 59 inwardly, a sufficient distance to bring the claw into engagement with the next tooth edge of toothed wheel as shown in FIG. 6, the force of spring 61 urges claw 59 in the direction indicated by arrow 74. As a result, claw 59 now engages the next tooth edge of toothed wheel 71. Thereafter, the user simply releases the inward force upon pushrod 27. Once the inward force has been removed, the force of spring 60 urges pushrod 27 outwardly in the direction indicated by arrow 73 drawing claw 59 against toothed wheel 71. This drawing force rotates toothed wheel 71 in the direction indicated by arrow 76. The rotation of toothed wheel 71 overcomes the restraining force of detent 65 forcing it upwardly in the direction indicated by arrow 78. The common attachment between post 72 and toothed wheel 71 and hemispherical elements 42 and 43 (element 42 seen in FIG. 2) produces a corresponding rotation of hemispherical elements 42 and 43 in the direction indicated by arrow 77.

The outward movement of pushrod 27 continues until stop 57 again impacts the cooperating surface of housing 41. Correspondingly, the termination of pushrod movement also terminates the rotation of toothed wheel 71 and hemispherical elements 42 and 43. The resulting position of toothed wheel 71 and elements 42 and 43 is maintained by detent 65. At this point, the configuration of eye change mechanism 40 has returned to the relaxed position shown in FIG. 5 and a pair of alternative eye images have been aligned with the eye apertures of the doll head. Additional changes of eye images are obtained by repeatedly pressing and releasing pushrod 27 to initiate and complete the above-described operational cycle.

What has been shown is a doll having changeable eyes in response to a push and release of a pushrod supported at the rear of the doll's head. A facial mask is removably supported upon the doll head to further alter the dolls features and appearance.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

What is claimed is:

1. A doll head comprising:

a head housing defining an interior cavity, a pair of doll eye apertures and a pair of ear portions;

an eye change mechanism supported within said interior cavity having a plurality of eye images and means for aligning a selected pair of said eye images with said eye apertures; and a facial mask having a facial portion, a pair of ear elements and a pair of mask eye apertures, said facial mask being removably securable to said doll head by engagement of said ear elements with said ear portions such that said mask eye apertures generally align with said doll eye apertures.

2. The doll head set forth in claim 1 wherein said facial mask is formed of a generally resilient material and wherein said facial mask deforms during attachment to said head housing to provide a snap fit attachment.

3. The doll head set forth in claim 2 wherein said head housing defines a rod aperture and wherein said eye change mechanism includes a pushrod extending through said not aperture.

4. The doll head set forth in claim 3 wherein said doll head defines a rear surface and wherein said rod aperture is defined in said rear surface.

* * * * *